United States Patent [19]

Palovaara

[11] 3,957,221

[45] May 18, 1976

[54] DEVICES FOR BRAKING SHEET-MATERIAL REELERS

[75] Inventor: Jaakko Palovaara, Jyvaskyla, Finland

[73] Assignee: Valmet Oy, Helsinki, Finland

[22] Filed: Apr. 1, 1975

[21] Appl. No.: 563,960

[30] Foreign Application Priority Data

Apr. 2, 1974 Finland ..... 1004/74

[52] U.S. Cl. ..... 242/99; 242/156.2

[51] Int. Cl.[2] ..... B65H 17/44

[58] Field of Search ..... 242/99, 156, 156.2, 242/67.1 R, 67.2, 67.3 R, 67.5

[56] References Cited

UNITED STATES PATENTS

| | | | |
|---|---|---|---|
| 2,406,846 | 9/1946 | Muller | 242/156 X |
| 2,507,297 | 5/1950 | Bouget | 242/156 |
| 3,688,999 | 9/1972 | Plattner | 242/156.2 |

*Primary Examiner*—Edward J. McCarthy
*Attorney, Agent, or Firm*—Steinberg and Blake

[57] ABSTRACT

A device for braking the rotation of a rotating roll of a sheet material such as paper, cardboard, or the like, when the reeling of the sheet material has been completed. The device is used in connection with a machine which has a rotary reel spool which rotates about its axis during reeling of sheet material thereon. Adjacent one end of the reel spool is a carriage, and both the carriage and the reel spool are guided for free movement along parallel paths perpendicular to the axis of the reel spool so that the carriage can be maintained along the axis of the reel spool during building of the roll of the sheet material thereon. The braking device includes one part which is fixed to the end of the reel spool which is adjacent the carriage while the remainder of the braking device is carried by the carriage for movement with respect thereto into cooperation with the part of the braking device which is fixed to the end of the reel spool so that when the braking device operates it will act through the part of the braking device fixed to the end of the reel spool in order to retard the rotation of the reel spool with the sheet material wound thereon.

10 Claims, 4 Drawing Figures

DEVICES FOR BRAKING SHEET-MATERIAL REELERS

BACKGROUND OF THE INVENTION

The present invention relates to devices for braking the rotation of reels of sheet material when the reeling operations are completed.

In particular, the present is designed for use in paper or cardboard machines where the paper or cardboard are reeled onto a reel spool or tambour roll. Thus, with the structure of the present invention it is possible to dissipate the rotary motion of the reeled body of sheet material, acquired during the reeling operation, until the sheet-material roll comes to a standstill.

It is already well known that in paper or cardboard machines the reeling mechanism for the finished paper or cardboard may include a so-called Pope cylinder driven in such a way as to have a peripheral velocity equal to the linear velocity of the completed web of sheet material. The paper or cardboard is reeled onto a so-called tambour roll or reel spool, with the paper or cardboard roll being urged, during the building thereof, against the Pope cylinder over which the web of the sheet material runs toward the roll which is being formed. During the reeling operation the tambour roll or reel spool is lodged in journal forks or on a roll carriage which is moved away from the Pope cylinder as the roll which is being formed increases in diameter. It is most common, at the present time, however, to support the reel spool so that it will roll upon supporting rails as the paper roll increases in diameter during reeling thereof. A suitable loading means maintains a sufficient contact pressure between the building sheet-material roll and the Pope cylinder.

It is of course known to provide reeling mechanisms with brakes for stopping the rotation of the completed roll. As a rule the braking operation is carried out at a fixed braking station to which the completed roll is transferred. The braking operations also may be performed by way of brake shoes fixed to the roll-displacing arms. In connection with reeling of relatively thick cardboard, it is known to use so-called floor brakes which stop the rotation of the roll by acting upon the surface thereof. With the exception of this latter type of construction, all known braking devices operate in such a way that the exterior surface at the end portions of the tambour roll or reel spool acts as a brake drum. This latter type of construction is of considerable disadvantage, however, in that the surface of the tambour roll is worn away and rendered useless after a relatively short period of time as a result of the frictional engagement with the brake shoe. A further drawback resides in the extremely large generation of heat at the part of the tambour roll or reel spool which is subjected to frictional engagement with the brake shoe. This latter drawback is of increasing significance with the ever-increasing width and speed of paper machines and increasing diameters of the rolls. This generation of heat may have a number of undesirable results among which are that the production of heat may loosen the shrinkage joint used in the tambour roll or it may destroy the rubber lining of the tambour roll.

Moreover, with the type of braking construction which is most commonly used, among those known in the prior art, which is to say that which has a fixed braking station, a large quantity of waste paper is produced because the outermost layers of the roll become loose as the roll rotates during the comparatively long time requried to transfer the roll to the braking station. This wastage of paper increases undesirably if for one reason or another relatively small roll sizes are provided as, for example, in the case where sample rolls are made when the operation of the machine is changed from one type of paper to another type of paper, inasmuch as in this case the transfer distance of such a roll which is smaller than the maximum diameter is even longer.

A further drawback of known braking devices resides in the fact that the braking takes place at the ends of the shell surface of the tambour roll, the portion thereof which must be used for engagement with the brake shoes reduces the space which is available for reeling of the paper.

SUMMARY OF THE INVENTION

It is accordingly a primary object of the present invention to provide devices for braking rotary reel spools in such a way that the above drawbacks are avoided.

Thus, it is an object of the present invention to provide a braking structure according to which the shell surface of the tambour roll for a paper web of predetermined width may be shortened when new machines are manufactured so that as a result the speed of rotation of the tambour roll may be increased (third power of the spacing of the bearings) and the weight of the tambour roll may be reduced (second power of the diameter).

It is also an object of the present invention to provide a construction for existing machines where it is possible to reel a wider web of sheet material than has heretofore been possible while utilizing the new braking device of the invention.

Furthermore, it is an object of the present invention to provide a braking device which will eliminate the drawbacks in connection with generation of heat, which are present in previously known constructions.

Also, it is an object of the present invention to provide a construction which does not require transfer of the reeled sheet material to a fixed braking station but which instead permits the braking operation to be carried out at a given time when the reeling operations have been completed.

According to the invention a machine which has an elongated rotary means onto which a sheet material such as paper, cardboard, or the like, is reeled while the rotary means rotates about its axis includes a carriage means situated along the latter axis adjacent one end of the rotary means. A support means supports both carriage means and the rotary means for free movement along a pair of parallel paths, respectively, which are perpendicular to the above axis so that the carriage means can move along one of these paths to remain along the above axis adjacent the end of the rotary means while the latter moves along the other of the paths during increase in the diameter of the sheet material which is reeled onto the rotary means. A braking means is provided for braking the rotation of the rotary means, and this braking means has one part fixed to the above end of the rotary means while the remainder of the braking means is carried by the carriage means for cooperating with the latter part of the braking means for braking the rotation of the rotary means after sheet material has been reeled thereon to a given extent.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
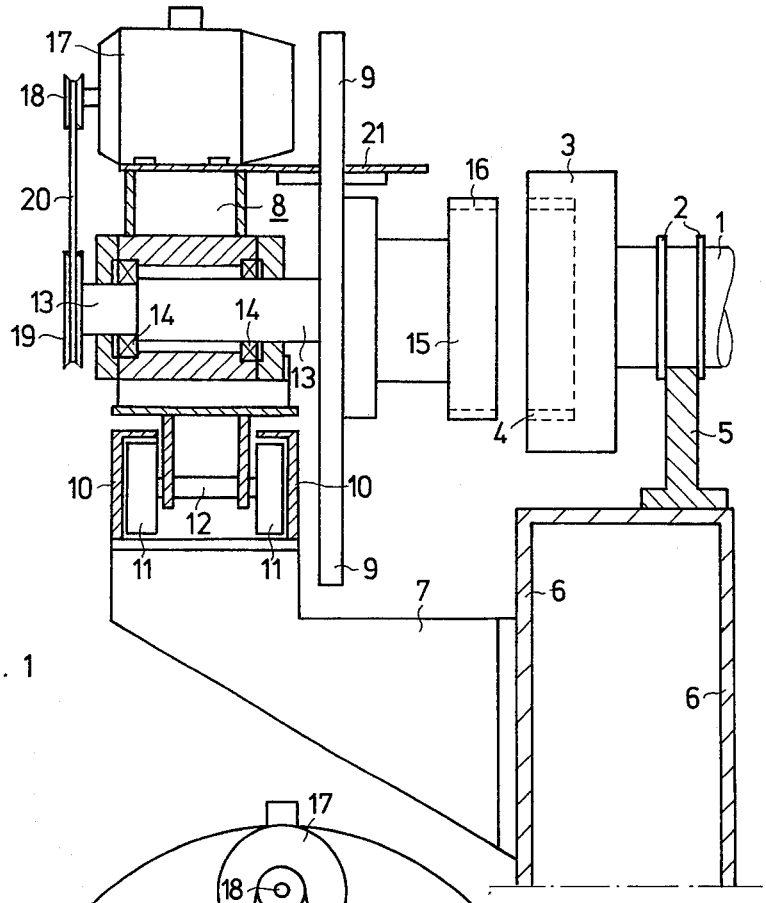
FIG. 1 is a partly schematic and partly sectional elevation of one embodiment of the structure of the invention, the section of FIG. 1 being taken in a vertical plane which contains the axis of the tambour roll or reel spool.

Referring now to FIG. 1, there is illustrated there part of the conventional reeling structure, this structure including the fragmentarily illustrated tambour roll or reel spool 1 which in a known way rotates about its axis during reeling of the paper, cardboard, or the like thereon. The reel spool 1 is supported for rotation in bearings carried by bearing housings 2, one of which is illustrated in FIG. 1 adjacent the end of the reel spool 1 which is illustrated in FIG. 1. The housing of the bearing 2 has flanges into which the upper end of a rail 5 extends so that in this way the spool 1 is supported for free rolling movement in a direction perpendicular to the axis of the spool 1 during the reeling of the sheet material onto the spool 1 while the diameter of the sheet material increases during formation of the roll on the spool 1. The rail 5 forms part of a support means which includes the fragmentarily illustrated frame structure 6 of the reeling unit of the machine. A brake means is provided for braking the rotation of the spool 1, and part of this brake means is formed by the element 3 which is fixed to the end of the spool 1 which is visible in FIG. 1. Thus, the spool 1 forms a rotary means onto which the sheet material is reeled with this rotary means rotating about its axis while having fixed to one end thereof a part 3 of a brake means of the invention. The illustrated part 3 is in the form of a coupling flange forming part of a coupling means which includes a hollow portion of the part 3. Thus, the part 3 is formed with an opening extending into the part 3 from the left surface thereof, as viewed in FIG. 1, and this opening is of a circular configuration and has gear teeth 4 formed along its inner periphery so that the gear teeth 4 form in effect an internal ring gear for coupling structure to the spool 1 by way of the part 3 of the brake means, as described in greater detail below.

By way of the supporting rail 5 it is possible for the tambour roll 1 resting on the rail 5 to move freely away from the unillustrated Pope cylinder by way of unillustrated means known in themselves, as the paper roll which is reeled onto the spool 1 increases in diameter.

Thus, the frame 6 together with the rail 5 form a support means supporting the rotary means 1 for movement along a path perpendicular to the axis of the rotary means 1, and this support means includes in addition the arms 7 which are fixed to and project laterally from the frame 6, these arms 7 serving to carry guides 10 for wheels 11 of a carriage means 8. The wheels 11 of the carriage means 8 are fixed with axles 12 which serve to carry directly the frame of the carriage means 8, the latter being movable along the guides 10 in synchronization with the movement of the spool 1 along the rails 5, by way of suitable chains, linkages, or equivalent structures which are not illustrated, so that in this way the carriage means 8 will be situated adjacent the end of the rotary means 1 which is illustrated in FIG. 1 along the axis of the rotary means 1 as the sheet-material is reeled onto the rotary means 1. Thus, the frame 6 together with the arms 7, rails 5 and guides 10 form a support means for supporting both the rotary means 1 and the carriage means 8 for free movement respectively along a pair of parallel paths which are perpendicular to the axis of the rotary means 1.

As was indicated above, the part 3 of the brake means of the invention is fixed directly to one end of the rotary means 1. The remainder of the brake means of the invention is carried by the carriage means 8. This remainder of the brake means includes a rotary portion part of which is formed by a shaft 13 coaxial with the rotary means 1 and having portion journalled in bearings 14 which are supported in a housing carried by the carriage means 8 as is apparent from FIG. 1. This rotary portion of the remainder of the brake means which is carried by the carriage means 8 also includes a coupling element 15 in the form of a flange projecting from one end of the rotary portion 13 and having at its exterior gear teeth 16 adapted to mate with the gear teeth 4 of the part 3 of the brake means. Thus the components 3 and 15 form a coupling means for coupling the rotary portion of the remainder of the brake means which is carried by the carriage means 8 to the reel spool 1 by rotation with the latter, in a manner described below.

The rotary portion of the brake means includes, in addition to the rotary shaft 13 and part 15, 16 of the coupling means, a rotary disc 9 which is fixed to the shaft 13 for rotation therewith and which forms part of a disc brake. Thus, the rotary disc 9 has an exterior side surface, situated at the left in FIG. 1, adapted to be engaged by braking elements 23 (FIG. 2) which form part of a conventional disc-brake assembly.

The carriage means 8 includes at its upper portion an elongated supporting plate 21 formed with an elongated opening through which the disc 9 freely extends, and this supporting plate 21 carries through suitable supporting brackets the pair of braking elements or brake shoes 23 which cooperate with a surface of the disc 9 to provide the frictional braking of the reel spool 1.

A drive means is provided for rotating the rotary portion 13 of the brake means, and in the illustrated example this drive means includes a D.C. motor 17 situated on the plate 21 and connected through a transmission 18-20 to the shaft 13 for rotating the latter together with the disc 9 and the coupling element 15, 16. This transmission means 18–20 includes a pair of pulleys 18 and 19 respectively fixed to the motor 17 and the shaft 13 and a V-belt 21 extending between the pulleys 18 and 19 for driving the pulley 19 when the motor 17 is energized. Most appropriately the D.C. motor 17 is connected in parallel with the electric drive of the paper machine so that it will have a speed of rotation which is proportional to the operating speed of the paper machine.

In order to place the braking structure carried by the carriage means 8 in a cooperative relationship with the part 3 of the brake means which is fixed to one end of the spool 1, the brake means further includes a displacing means 22 in the form of a pair of hydraulic piston-and-cylinder assemblies including, for example, cylinders fixed to the carriage means 8 and pistons slidable with respect to the cylinders and connected with the housing which carries the bearings 14, this housing having a pair of lower extensions 24 (FIG. 2) which are parallel to the shaft 13 and which are received in mating parallel grooves of guide elements which are fixed to and form part of the carriage means 8 so that by way of the displacing means 22 and the guide means 24 it is possible to guide the braking structure carried by the carriage means 8 along the common axis of the shaft 13 and the tambour roll 1 into and out of a cooperative relationship with the part 3 of the brake means. Thus, while the parts 11, 12 and the carriage structure 8 directly carried thereby will remain at a predetermined distance from the spool 1, the entire braking structure carried by the carriage means 8 is displaceable with respect thereto along the common axis of the shaft 13 and the reel spool 1 in response to operation of the power cylinders 22. When this braking structure carried by the carriage means 8 is shifted in this way toward the right, as viewed in FIG. 1, the teeth 16 mesh with the teeth 4 so that the coupling means 15, 3 is in a coupling position coupling the rotary portion 13 of the brake means to the part 3.

The above-described structure shown in FIGS. 1 and 2 operates in the following manner:

During reeling of a sheet material such as paper, cardboard, or the like, onto a reel spool or tambour roll 1, even while the latter is adjacent the Pope cylinder when the reeling operation is started with a particular rotary means 1, the D.C. motor is automatically started and it accelerates the rotation of the shaft 13 and the parts carried thereby up to a speed of rotation slightly lower than the speed of rotation of the reel 1. The D.C. motor is situated in a suitable electrical circuit so as to be automatically adjusted in its speed so that the speed of rotation of the rotary portion 13 will vary with the speed of rotation of the rotary means 1. As is well known, while the linear speed of the web of sheet material which is reeled onto the rotary means 1 remains constant, the speed of rotation of the rotary means 1 will at the beginning be at a maximum value and will gradually diminish, and when the speed of the rotary means 1 becomes equal to the speed of rotation of the shaft 13 and the coupling element 15, 16 the displacing means 22 is automatically actuated to shift the braking structure carried by the carriage means 8 to the right, as viewed in FIG. 1, so that the coupling means 3, 15 will become engaged with the gear teeth 16 meshing with the gear teeth 4. Of course, the direction of rotation of the motor 17 is such that the coupling element 15 rotates in the same direction as the coupling element 3. This automatic coupling of the part 3 of the brake means with the remainder thereof carried by the carriage means 8, by way of the coupling means 3, 15, may be governed by a suitable limit switch. When the carriage means 8 starts moving along the guides 10 from a given rear position such as that shown in FIG. 1, an unillustrated limit switch will respond when a predetermined position of the carriage means 8 along the guides 10 is reached, and in response to operation of this latter limit switch the supply of current to the motor 17 is terminated. Of course, this operation takes place after the components 3 and 15 of the coupling means have become coupled to each other, so that with the power supply to the drive means 17 cut off the rotation of the rotary portion of the brake means, which is carried by the carriage means 8, is brought about by way of a drive from the reel spool 1 through the engaged coupling means 3, 15. Thus, from this point on the rotary portion of the brake means rotates together with the rotary means 1 while continuing to move together with the latter along the paths determined by the rail 5 and the guides 10, a suitable synchronous drive which is not illustrated and which has been referred to above providing for maintenance of the brake structure carried by the carriage means 8 in axial alignment with the rotary means 1. Thus, as the diameter of the roll of paper building on the rotary means 1 increases the brake structure carried by the carriage means 8 remains coaxial with the rotary means 1 and the part 3 fixed thereto.

At the moment when it is desired to brake the rotation of the rotary means 1 together with the sheet material reeled thereon, the brake shoes 23 are actuated in a known way so as to frictionally engage the brake disc 9, and thus it is possible to retard the rotation of the reel of sheet material, until the latter is brought to a standstill, with a structure where the frictional braking action takes place at a location distant from the rotary means 1 while at the same time the braking can be applied at any desired moment.

When the completed roll has moved away from the Pope cylinder into the extreme position of the loading device, the coupling means is automatically disengaged by automatic actuation of the displacing means 22 in order to displace the braking structure carried by the carriage means 8 in an opposite direction, to the left, as viewed in FIG. 1, separating the coupling component 15, 16 from the part 3, 4 so that the coupling means is now disengaged. Thus, the coupling means is automatically disengaged and a new tambour roll 1 is carried along the supporting rails 5 to the end of the unit adjacent the Pope cylinder, at which point the motor 17 is again automatically started and the above operations are repeated.

Figure 3:
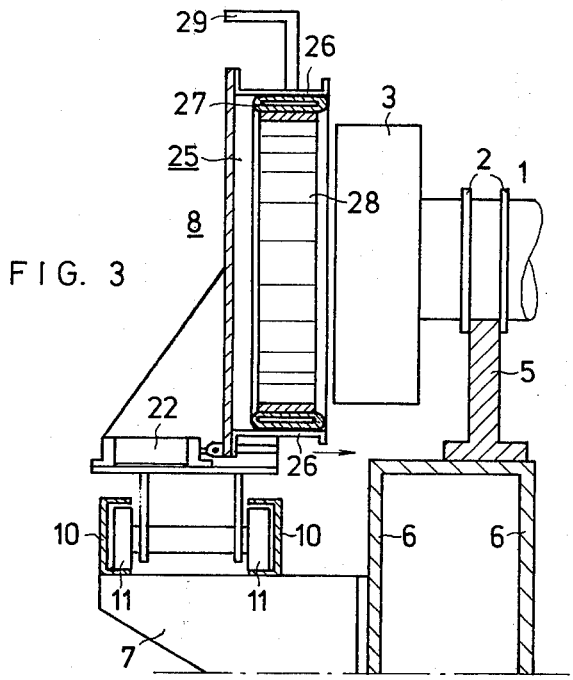
FIG. 3 is a partly schematic fragmentary and partly sectional elevation of another embodiment of the invention taken in a plane which contains the axis of the reel spool.
Figure 4:
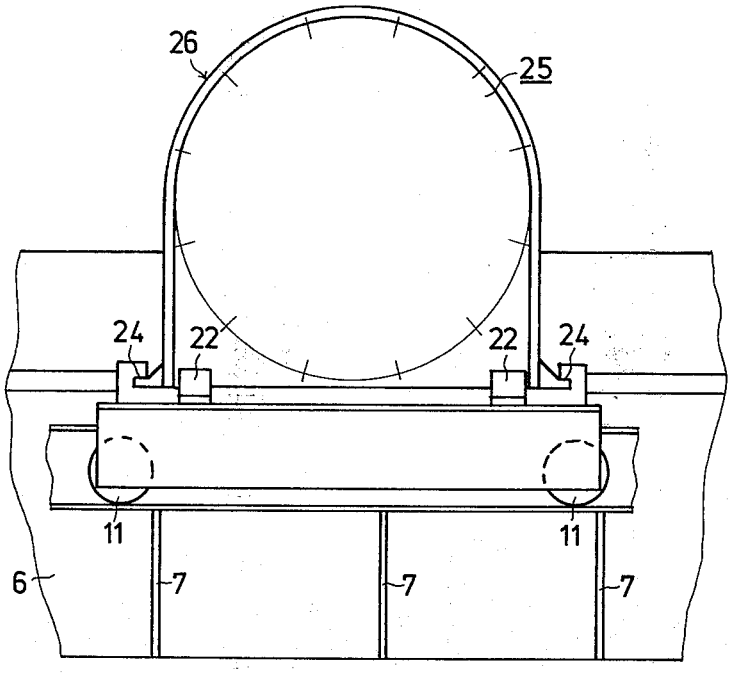
FIG. 4 is a fragmentary end elevation of the structure of FIG. 3 as seen from the left of FIG. 3.

In the embodiment of the invention which is illustrated in FIGS. 3 and 4, the motor 17 and the rotary portion 13 driven thereby have been omitted. Instead of a disc brake and structure associated therewith, the embodiment of FIG. 3 and 4 includes the remainder 25 of the brake means of this embodiment which cooperates with the part 3 of the brake means carried by one end of the rotary means 1. The part 3 in this case is a simple cylindrical member fixed coaxially to the rotary means 1 and projecting radially from the latter at one end thereof, as shown in FIG. 3.

The portion 25 of the brake means of the embodiment of FIGS. 3 and 4 may be any type of friction brake known in the prior art and acting to provide an inwardly directed friction brake pressure directed toward the axis of rotation of the rotary means 1. For this purpose FIGS. 3 and 4 illustrate a brake structure which includes an exterior cylindrical housing 26 having in engagement with its inner surface a hollow rubber ring 27 cooperating with a suitable supply of fluid under pressure by way of a conduit 29. This hollow expandable and contractable ring 27 fixedly carries at its inner periphery friction members 28 which thus will be shifted inwardly radially toward the axis of the cylinder 26, which coincides with the axis of the rotary means 1, when fluid under pressure is supplied to the interior of the ring 27 so as to expand the inner periphery of the latter inwardly away from the housing 26.

Figure 2:
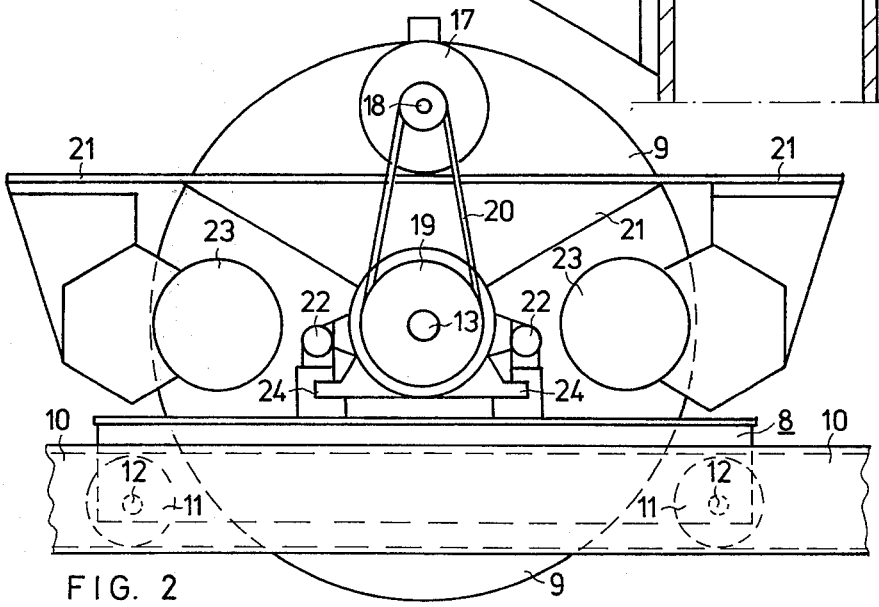
FIG. 2 is a fragmentary schematic end view of the structure of FIG. 1 as seen from the left of FIG. 1.

The embodiment of FIGS. 3 and 4 is similar to that of FIGS. 1 and 2, however, in that the brake structure carried by the carriage means 8 is axially shiftable, along the axis of the rotary means 1, by way of displacing means 22 which may be identical with the displacing means of FIGS. 1 and 2, with the carriage means having the guides 24 which act to guide the cylinder 26 along the axis of the rotary means 1 in response to operation of the displacing means 22. Thus, by way of the displacing means 22 it is possible to shift the housing 26 to the right, as indicated by the arrow in FIG. 3, to a position where the friction elements 28 surround while being initially spaced slightly from the external periphery of the part 3 of the braking means which is fixed directly to one end of the rotary means 1.

In the following the operation of the embodiment of FIG. 3 and 4 is described only in connection with differences between the operation of the embodiment of FIGS. 3 and 4 as compared with the embodiment of FIGS. 1 and 2.

Initially the inner diameter of a cylinder along which elements 28 are distributed is larger than the outer diameter of part 3 of the brake means so that even when the displacing means 22 displaces the drum 26 into a position surrounding the part 3 the friction elements 28 do not engage the periphery of the part 3. In this way there is no difficulty in shifting the axially movable part of the brake means into and out of operative relationship with respect to the rotary part 3 thereof. Thus with this embodiment there is no necessity for rotational synchronization as is required between the gears 4 and 16 of the coupling means of FIGS. 1 and 2.

WIth the elements 28 thus being distributed around the part 3, when it is desired to bring about braking of the rotary means 1, a fluid under pressure is introduced through the pipe 29 into the rubber ring 27 so that the friction elements 28 are pressed directly against the exterior cylindrical surface of the part 3, and thus braking takes place. Once the rotation of the rotary means 1 is terminated in this way the fluid under pressure can be withdrawn from the ring 7 so as to retract elements 28 and now the parts can return to the position shown in FIG. 3.

The advantage of the embodiment of the invention shown in FIGS. 3 and 4, as compared with that of FIGS. 1 and 2, resides in the fact that the embodiment of FIGS. 3 and 4 is simple and less expensive while at the same time it is possible with the embodiment of FIGS. 3 and 4 to initiate the braking action at a desired instant and at an arbitrarily determined location of the rotary means 1 along the guide rails 5. However, the drawback of the embodiment of FIGS. 3 and 4 resides in the fact that with passage of time the exterior surface of element 3 will become worn, as has been pointed out above. However, this latter drawback may in some cases be accepted as where the exterior surface of element 3 need no longer be utilized, for example, in the case of coating machine or another type of after-treatment. If it is to be expected that the utilization of the exterior surface of element 3 for braking purposes will introduce an appreciable drawback, then of course the more expensive construction of FIGS. 1 and 2 should be used, since the difficulties in connection with wear are avoided in the embodiment of FIGS. 1 and 2.

The invention need not be confined to the details of the embodiments described by way of example above, since these details may vary within the scope of the claims below. For example, the means to carry out the actual braking need not be of the type shown in the drawings and described above nor need the braking structure be disposed directly on the shaft 13. It is also possible that the braking action is totally or partially brought about by way of the D.C. motor 17 which may be connected into a suitable electrical circuit for dissipating energy into an external resistance or for refeeding the braking energy by way of a useful braking process into the electrical mains from which energy is derived for the entire machine. This latter operation is particularly advantageous from the standpoint of economizing of the use of energy. It is also clear that the construction of the coupling means for connecting the shaft 13 with the rotary means 1 may differ greatly from that shown in the drawings and described above.

What is claimed is:

1. In a machine having an elongated rotary means onto which a sheet material, such as paper, cardboard, or the like, is reeled while said rotary means rotates about its axis, said rotary means having one end which extends across said axis, carriage means situated along said axis adjacent but beyond said one end of said rotary means, support means supporting said carriage means and said rotary means for free movement along a pair of parallel paths, respectively, which are perpendicular to said axis so that said carriage means can move along one of said paths to remain along said axis adjacent said end of said rotary means while the latter moves along the other of said paths during increase in the diameter of the sheet material reeled onto said rotary means, and braking means for braking the rotation of said rotary means, said braking means having one part fixed to said end of said rotary means while the remainder of said braking means is carried by said carriage means for cooperating with said one part of said braking means for braking the rotation of said rotary means after sheet material has been reeled thereon to a given extent.

2. The combination of claim 1 and wherein said remainder of said braking means remains out of engagement with said part of said braking means which is fixed to said end of said rotary means during rotation of the latter while sheet material is reeled thereon, and said remainder of said braking means including a displacing means carried by said carriage means for displacing said remainder of said braking means into engagement with said part of said braking means which is fixed to said end of said rotary means when braking of the latter is carried out by said braking means.

3. The combination of claim 2 and wherein during reeling of sheet material onto said rotary means said remainder of said braking means is situated axially beyond said part of said braking means which is fixed to said end of said rotary means and said displacing means displacing said remainder of said braking means along said axis of said rotary means into cooperative relationship with said part of said braking means when braking of said rotary means is to be carried out.

4. The combination of claim 1 and wherein said remainder of said braking means includes a rotary portion coaxial with said rotary means and a coupling means for coupling said rotary portion of said braking means to said part thereof which is fixed to said rotary means so that said rotary portion of said braking means will then rotate together with said rotary means, said remainder of said braking means including a drive means for rotating said rotary portion of said braking means about said axis in the same direction as said rotary means prior to coupling by said coupling means so that when coupling is brought said rotary portion of said braking means rotates in the same direction as said rotary means, and said remainder of said braking means including at least one braking element for engaging said rotary portion while the latter rotates together with said rotary means for applying a braking force to said rotary portion and through said coupling means to said part of said braking means fixed to said rotary means for retarding the rotation of the latter.

5. The combination of claim 4 and wherein said rotary portion of said braking means includes a rotary disc and said braking element engaging a surface of said rotary disc.

6. The combination of claim 1 and wherein said remainder of said braking means cooperates frictionally with said part of said braking means fixed to said end of said rotary means for applying a frictional braking force directly to said part of said braking means to retard the rotation of said rotary means.

7. The combination of claim 5 and wherein said rotary disc and said braking element form a conventional disc brake assembly.

8. The combination of claim 3 and wherein said displacing means includes at least one hydraulic piston-and-cylinder assembly fixed in part to said carriage means and in part to said remainder of said braking means for displacing the latter into cooperative relationship with said part of said braking means fixed to said end of said rotary means, and said carriage means carrying a guide means for guiding said remainder of said braking means along said axis of said rotary means into and out of cooperative relationship with said part of said braking means which is fixed to said end of said rotary means.

9. The combination of claim 4 and wherein said drive means includes a direct current motor and a transmission between the latter and said rotary portion of said braking means for rotating said portion, whereby said direct current motor is capable of being regulated in its speed of rotation in conformity with the speed of rotation of said rotary means.

10. The combination of claim 9 and wherein said direct current motor operates at least in part as a braking means for contributing to the braking of said rotary means by dissipating energy of said rotary means into an external resistance.

* * * * *